US010349505B2

(12) United States Patent
Heidrich et al.

(10) Patent No.: US 10,349,505 B2
(45) Date of Patent: Jul. 9, 2019

(54) HIGH-VOLTAGE SUPPLY AND AN X-RAY EMITTER HAVING THE HIGH-VOLTAGE SUPPLY

(71) Applicant: SIEMENS HEALTHCARE GMBH, Erlangen (DE)

(72) Inventors: Guenter Heidrich, Gerhardshofen (DE); Jan Matschulla, Oderwitz (DE); Raimund Schwarz, Erlangen (DE)

(73) Assignee: Siemens Healthcare GmbH, Erlangen (DE)

( * ) Notice: Subject to any disclaimer, the term of this patent is extended or adjusted under 35 U.S.C. 154(b) by 368 days.

(21) Appl. No.: 15/216,888

(22) Filed: Jul. 22, 2016

(65) Prior Publication Data

US 2017/0027046 A1 Jan. 26, 2017

(30) Foreign Application Priority Data

Jul. 22, 2015 (DE) ..... 10 2015 213 810

(51) Int. Cl.

| | |
|---|---|
| ***H05G 1/02*** | (2006.01) |
| ***H05G 1/08*** | (2006.01) |
| ***H05G 1/10*** | (2006.01) |
| ***H01J 35/06*** | (2006.01) |
| ***H01J 35/16*** | (2006.01) |

(52) U.S. Cl.

CPC ..... *H05G 1/10* (2013.01); *H01J 35/06* (2013.01); *H01J 35/16* (2013.01); *H05G 1/02* (2013.01); *H05G 1/08* (2013.01)

(58) Field of Classification Search

CPC .. H05G 1/08; H05G 1/10; H05G 1/12; H05G 1/14; H05G 1/18; H05G 1/20; H05G 1/22; H05G 1/02; H01J 35/16; H01J 35/06

USPC ..... 378/101, 136

See application file for complete search history.

(56) References Cited

U.S. PATENT DOCUMENTS

| | | | | |
|---|---|---|---|---|
| 4,559,640 A | | 12/1985 | Le Guen et al. | |
| 4,577,339 A | * | 3/1986 | Klostermann | H05G 1/08 378/121 |
| 4,920,554 A | * | 4/1990 | Gabbay | H01J 35/16 378/200 |
| 4,972,459 A | * | 11/1990 | Sommer | H05G 1/08 333/12 |
| 5,060,253 A | * | 10/1991 | Jedlitschka | H05G 1/06 363/61 |
| 5,154,638 A | | 10/1992 | Sireul et al. | |

(Continued)

FOREIGN PATENT DOCUMENTS

| | | |
|---|---|---|
| DE | 3221824 A1 | 1/1983 |
| DE | 69006331 T2 | 5/1994 |
| EP | 0810815 A1 | 12/1997 |

*Primary Examiner* — Allen C. Ho

(74) *Attorney, Agent, or Firm* — Laurence Greenberg; Werner Stemer; Ralph Locher

(57) ABSTRACT

A high-voltage supply for an x-ray emitter, in particular to provide a cathode current and a cathode voltage, has at least two electrical conductors, which are incorporated in a common insulating body. Each electrical conductor is assigned a connector element, which is configured for electrically conducting contact with a corresponding connector of the x-ray emitter. Such a high-voltage supply for supplying the cathode voltage and the cathode current is provided in an x-ray emitter. The high-voltage supply extends at least in part over an inner region of a radiation protection housing of the x-ray emitter.

12 Claims, 4 Drawing Sheets

(56) References Cited

U.S. PATENT DOCUMENTS 5,231,564 A * 7/1993 Pellegrino ..... H02M 7/103 363/61
5,257,304 A * 10/1993 Sireul ..... H05G 1/10 363/59
5,272,612 A * 12/1993 Harada ..... H02M 3/28 363/26
5,303,283 A * 4/1994 Jedlitschka ..... H05G 1/06 378/119
5,335,161 A * 8/1994 Pellegrino ..... H02M 7/106 363/61
5,384,821 A * 1/1995 Jedlitschka ..... H05G 1/04 378/193
5,442,677 A * 8/1995 Golden ..... H05G 1/06 378/101
5,497,409 A * 3/1996 Jedlitschka ..... H05G 1/04 378/101
5,517,545 A * 5/1996 Nakamura ..... H05G 1/06 378/101
5,596,621 A * 1/1997 Schwarz ..... H01J 35/00 378/130
5,602,897 A * 2/1997 Kociecki ..... H05G 1/06 378/101
5,878,109 A 3/1999 Negle et al.
6,097,789 A * 8/2000 Mueller ..... H01J 35/10 378/130
6,198,802 B1 * 3/2001 Elliott ..... A61B 6/032 378/101
6,385,294 B2 * 5/2002 Suzuki ..... H01J 5/52 378/121
6,415,016 B1 * 7/2002 Chornenky ..... A61N 5/1001 378/121
6,418,191 B1 * 7/2002 Fehre ..... H05G 1/20 362/21
6,452,102 B1 9/2002 DeForest, Jr. et al.
6,480,572 B2 * 11/2002 Harris ..... H01J 35/06 378/136
6,556,654 B1 * 4/2003 Hansen ..... H05G 1/02 378/101
6,570,962 B1 * 5/2003 Maska ..... H01J 35/16 378/121
6,600,809 B1 * 7/2003 Ochiai ..... G01N 23/04 378/101
6,619,842 B1 * 9/2003 Artig ..... H01J 35/10 378/140
6,639,969 B2 * 10/2003 Ochiai ..... H01J 3/028 378/101
6,661,875 B2 * 12/2003 Greenwald ..... H01J 35/025 378/119
6,738,275 B1 * 5/2004 Beland ..... H02M 1/088 363/21.02
6,801,599 B1 * 10/2004 Kautz ..... H01J 35/14 378/138
6,975,698 B2 * 12/2005 Katcha ..... A61B 6/56 378/101
6,989,486 B2 * 1/2006 Lovoi ..... A61N 5/1001 174/110 R
7,006,601 B2 * 2/2006 Suzuki ..... H05G 1/06 378/101
7,016,468 B1 * 3/2006 Krema ..... H05G 1/34 378/101
7,031,433 B2 * 4/2006 Suzuki ..... H05G 1/06 378/102
7,110,499 B2 * 9/2006 Beyerlein ..... H05G 1/12 378/101
7,175,803 B2 * 2/2007 Artig ..... H01J 35/16 378/203
7,197,114 B2 * 3/2007 Le-Pierrard ..... H01J 35/165 378/121
7,203,280 B2 * 4/2007 Anno ..... H05G 1/04 378/130
7,218,707 B2 * 5/2007 Holm ..... H01J 35/16 378/121
7,236,569 B2 * 6/2007 Takeuchi ..... H01J 35/16 378/136
7,340,035 B2 * 3/2008 Tang ..... H01J 35/025 378/111
7,440,547 B2 * 10/2008 Ishiyama ..... A61B 6/032 378/101
7,448,801 B2 * 11/2008 Oettinger ..... H05G 1/06 378/102
7,466,799 B2 * 12/2008 Miller ..... H01J 35/16 378/121
7,623,629 B2 * 11/2009 Ito ..... H01J 9/26 378/121
7,664,229 B2 * 2/2010 Okada ..... H01J 35/08 378/121
7,668,295 B2 * 2/2010 Tang ..... H05G 1/10 378/101
7,720,199 B2 * 5/2010 Inazuru ..... H01J 35/025 378/119
7,722,252 B2 * 5/2010 Tang ..... H05G 1/08 378/207
7,734,015 B2 * 6/2010 Okada ..... H01J 35/08 378/122
7,773,726 B2 * 8/2010 Inazuru ..... H01J 35/08 378/119
7,826,586 B2 * 11/2010 Nakayama ..... A61B 6/035 378/101
7,848,482 B2 * 12/2010 Nakayama ..... A61B 6/035 378/101
7,949,099 B2 * 5/2011 Klinkowstein ..... H05G 1/10 378/121
8,090,075 B2 * 1/2012 Holm ..... H01J 35/165 378/141
8,213,575 B2 * 7/2012 Tamura ..... H01J 35/04 378/136
8,308,506 B2 * 11/2012 Tang ..... H01B 9/027 439/502
8,331,533 B2 * 12/2012 Yamamoto ..... H01J 35/025 378/101
8,340,250 B2 * 12/2012 Lemaitre ..... A61B 6/032 378/122
8,379,799 B2 * 2/2013 Parker ..... H01J 35/165 378/121
8,526,574 B2 * 9/2013 Wang ..... H05G 1/12 378/101
8,675,817 B2 * 3/2014 Ogata ..... H01J 35/045 378/101
8,675,818 B2 * 3/2014 Wassom ..... H01J 35/16 378/119
8,761,344 B2 * 6/2014 Reynolds ..... H01J 35/14 378/136
8,761,345 B2 * 6/2014 Shimono ..... H01J 35/06 378/140
8,804,910 B1 * 8/2014 Wang ..... H01J 35/16 378/101
8,848,873 B2 * 9/2014 Duhamel ..... H05G 1/10 378/111
9,048,058 B2 * 6/2015 Yamazaki ..... H01J 35/02
9,058,958 B2 * 6/2015 Aoki ..... H01J 35/04
9,070,531 B2 * 6/2015 Ueda ..... H05G 1/025
9,155,185 B2 * 10/2015 Reijonen ..... H01J 35/04
9,257,255 B2 * 2/2016 Dittrich ..... H01J 35/105
9,258,873 B2 * 2/2016 Igney ..... H05G 1/56
9,263,226 B2 * 2/2016 Zhao ..... G01N 23/04
9,420,676 B2 * 8/2016 Chen ..... H05G 1/025
9,603,230 B2 * 3/2017 Wiedmann ..... G01R 1/203
9,754,758 B2 * 9/2017 Park ..... H01J 35/12
9,824,847 B2 * 11/2017 Kato ..... H01J 35/165
9,831,024 B2 * 11/2017 Friedemann ..... H01F 17/06
9,842,720 B2 * 12/2017 Berk ..... H05G 1/06
9,847,207 B2 * 12/2017 Tezuka ..... H01J 35/06
9,892,883 B2 * 2/2018 Anno ..... H01J 35/16
9,936,568 B2 * 4/2018 Takahashi ..... H05G 1/48
9,947,426 B2 * 4/2018 Perkins ..... G21G 4/02
10,096,446 B2 * 10/2018 Hadland ..... H01J 35/025
10,181,390 B2 * 1/2019 Takahashi ..... H01J 35/165
2011/0002446 A1 1/2011 Beland

(56) References Cited

U.S. PATENT DOCUMENTS

| | | | |
|---|---|---|---|
| 2011/0058643 | A1 | 3/2011 | Lamaitre et al. |
| 2012/0027179 | A1 | 2/2012 | Ogata et al. |
| 2012/0189103 | A1 | 7/2012 | Duhamel |

* cited by examiner

HIGH-VOLTAGE SUPPLY AND AN X-RAY EMITTER HAVING THE HIGH-VOLTAGE SUPPLY

CROSS-REFERENCE TO RELATED APPLICATION

This application claims the priority, under 35 U.S.C. § 119, of German application DE 10 2015 213 810.0, filed Jul. 22, 2015; the prior application is herewith incorporated by reference in its entirety.

BACKGROUND OF THE INVENTION

Field of the Invention

The invention relates to a high-voltage supply for an x-ray emitter, in particular to supply voltage to a cathode of the x-ray emitter. The invention further relates to an x-ray emitter having such a high-voltage supply with at least one cathode and one anode, which are arranged in a vacuum housing, which is enclosed by a radiation protection housing.

Space economies in the area of high-voltage components are problematic, as they generally reduce the distance between components at different electrical potentials, thus increasing the risk of short circuits or dielectric flashover. The technology of x-ray emitters typically requires potential differences of several 10 kV to 200 kV, depending on the field of application. Also in the case of medical applications the required x-ray voltage or potential difference is a function of both the object to be examined and the desired contrast.

In the case of x-ray emitters a cathode current for heating a cathode is generally supplied at the voltage level of the cathode, which is for example 150 kV lower than the voltage level of an anode when used for medical diagnostics. To generate the cathode current it is known for example from published European patent application EP 0 810 815 A1 (corresponding to U.S. Pat. No. 5,878,109) to use heater transformers which contains in particular a primary and secondary coil. Such heater transformers or converters can be incorporated in the radiation protection housing so that the cathode current can be supplied at voltages which are much lower than the high-voltage level. However such embodiments require more space in the radiation protection housing. Published, European patent application EP 0 810 815 A1 therefore proposes a concentric arrangement of the primary and secondary coil to compensate at least partially for the greater space requirement. An air gap of at least several millimeters is present between the primary and secondary coil for insulation purposes.

Based on this prior art it is the object of the present invention to specify a high-voltage supply for x-ray emitters, in particular for x-ray emitters of imaging facilities for medical diagnostics, which have sufficient flashover resistance but are still compact in structure.

SUMMARY OF THE INVENTION

It is accordingly an object of the invention to provide a high-voltage supply and an x-ray emitter having the high-voltage supply that overcome the above-mentioned disadvantages of the prior art devices this general type.

According to the invention a high-voltage supply for an x-ray emitter, in particular for providing a cathode current and a cathode voltage, has at least two electrical conductors, which are incorporated in a common insulating body. Each electrical conductor is assigned a connector element, which is configured for electrically conducting contact with a corresponding connector of the x-ray emitter.

The high-voltage supply has been structured in the form of a through passage, which satisfies the requirements of at least two-pole contact with the cathode. The electrical conductor carrying the high voltage and the electrical conductor carrying the cathode current are incorporated in the insulating body in such a manner that the cathode voltage can be supplied to the cathode insulated from the cathode current. The cathode current here is supplied essentially at the voltage level of the cathode voltage, which—as mentioned above—can be at a voltage potential of more than −75 kV compared to earth according to possible exemplary embodiments. The anode voltage in this instance can be for example at a higher voltage level of +75 kV compared to earth.

No restrictions are required with regard to the structure and mode of operation of the cathode. In particular the cathode can be configured for the thermal emission of electrons and can comprise one or more filaments. Depending on the number of filaments provided, the high-voltage supply is then embodied with a corresponding number of poles. In other exemplary embodiments a thermoionic flat emitter is provided. However the high-voltage supply is equally suited to supplying a cathode current to a cathode which releases electrons generated by field emission.

The high-voltage supply is particularly suited to use in x-ray emitters of medical imaging facilities, in particular computed tomography, mammography or angiography facilities.

The insulating body of the high-voltage supply preferably has a flange for connection to a radiation protection housing of the x-ray emitter. The flange is used for the mechanical fastening of the high-voltage supply, which in the mounted state extends within a radiation protection housing of the x-ray emitter. A mechanically stable connection can minimize the risk of a break in contact in the region of the connectors.

The insulating body consists for example of an electrically insulating casting compound, for example an epoxy grout.

According to possible exemplary embodiments of the invention the connector elements of the high-voltage supply are arranged on a board. Each connector element is connected to the assigned electrical conductor in an electrically conducting manner by way of conduction paths. The board is sufficiently stable mechanically to meet the requirements for use in x-ray facilities. The conduction paths are arranged at a sufficient distance from one another so that voltage differences in the region of at least 200 V can be tolerated. Such embodiments correspond to a modular design, in which the board is provided as a separate part to supply the cathode currents and the cathode voltage. The insulating body with the electrical conductors incorporated therein serves as a high-voltage plug making contact with the board. It is thus possible to combine boards and high-voltage plugs of different types to meet the requirements for use in differently configured x-ray emitters.

As a development of the invention at least one electrically insulating insulation element is provided to brace the board against a wall of the radiation protection housing. The insulation element is used for the mechanically stable connection of the board which is to be mounted on the cathode connector of the x-ray emitter.

The at least one insulation element preferably has a ribbed shape to lengthen a creep distance. Such high-voltage technology parts can have in particular an essentially cylindrical shape with projections extending radially in the manner of plates. The lengthening of the creep distance also reduces the risk of dielectric flashover.

To reduce the space required for the high-voltage supply further it has proven advantageous, depending on the spatial dimensions of the x-ray emitter, to provide angled embodiments, in which the at least two electrical conductors run in a curved manner within the insulating body.

The connector elements are preferably configured to provide a plug-type connection to corresponding and complementarily configured connectors of the x-ray emitter. The connector elements of the high-voltage supply are particularly preferably configured as connector pins, connector sockets or blade contacts.

The cited object is also achieved by an x-ray emitter with one of the high-voltage supplies described above so reference is first made to the embodiments relating thereto.

The x-ray emitter comprises at least one vacuum housing serving as an x-ray tube, in which at least one cathode and one anode are arranged, and a radiation protection housing enclosing the vacuum housing.

The anode here can be embodied as a fixed or stationary anode or preferably as a rotating anode in a manner known per se. In another exemplary embodiment a rotary piston anode is provided, the anode forming a wall of a rotatably supported vacuum housing.

The radiation protection housing has in particular a shield, for example in the form of a lead covering. The x-ray radiation generated exits from the radiation housing through a window that is essentially transparent to the wavelength range in question.

According to the invention the high-voltage supply makes contact with connectors of the cathode which are arranged within the radiation protection housing, to ensure provision of the cathode voltage or cathode current. The high-voltage supply here is arranged at least partially within the radiation protection housing. In other words the high-voltage supply forms a type of through passage to provide the high-voltage supply and the cathode current supply. The high-voltage supply here extends at least in part over an inner region of the radiation protection housing. The high-voltage supply is configured as at least two-pole. In other words at least two electrical conductors are provided for the voltage and current supply, being incorporated in a common insulating body. Each electrical conductor is assigned a respective connector element, which is connected to a corresponding connector in an electrically conducting manner.

The cathode current is supplied electrically insulated from the high-voltage supply of the cathode voltage, which determines the voltage difference between cathode and anode.

A liquid or gaseous, electrically insulating medium, in particular an electrically non-conducting oil, is preferably introduced in the inner region within the radiation housing of the x-ray emitter. During appropriate use of the x-ray emitter the medium is used for electrical insulation. Liquid media can also be used to dissipate heat, therefore as coolants. During operation the high-voltage supply is therefore enclosed by the liquid or gaseous medium, the electrically insulating properties of which additionally increase the flashover resistance of the arrangement, thus reducing the risk of short circuits further.

The high-voltage supply is preferably connected to the radiation protection housing by a flange arranged on the insulating body. Such a configuration is mechanically stable, so the corresponding connector elements of the high-voltage supply can make reliable contact with the connectors of the cathode.

According to possible exemplary embodiments the connector elements are arranged on a board. Each connector element is connected to the assigned electrical conductor in an electrically conducting manner by way of conduction paths. It is particularly preferably for the board, which is configured as flat, to be fastened by at least one electrically insulating insulation element to a wall of the radiation protection housing. Such increased stability is particularly expedient for exemplary embodiments in which the x-ray emitter is used as a rotating emitter of a computed tomography facility, to enable it to withstand the centrifugal forces that occur.

In the simplest instance the connector elements or connectors can be solder joints for connection. The connector elements are preferably provided for plug-type connection to corresponding complementarily configured connectors. Plug-type connections are particularly desirable for simplified mounting. In the mounted state the connector elements of the high-voltage supply form a mechanically robust plug-type connection with the connectors of the x-ray emitter to supply the cathode current and the cathode voltage.

The properties, features and advantages of the present invention as described above and the manner in which these are achieved will become clearer and more comprehensible in conjunction with the description which follows of the exemplary embodiments described in more detail with reference to the drawings.

Other features which are considered as characteristic for the invention are set forth in the appended claims.

Although the invention is illustrated and described herein as embodied in a high voltage supply for an X-ray emitter, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
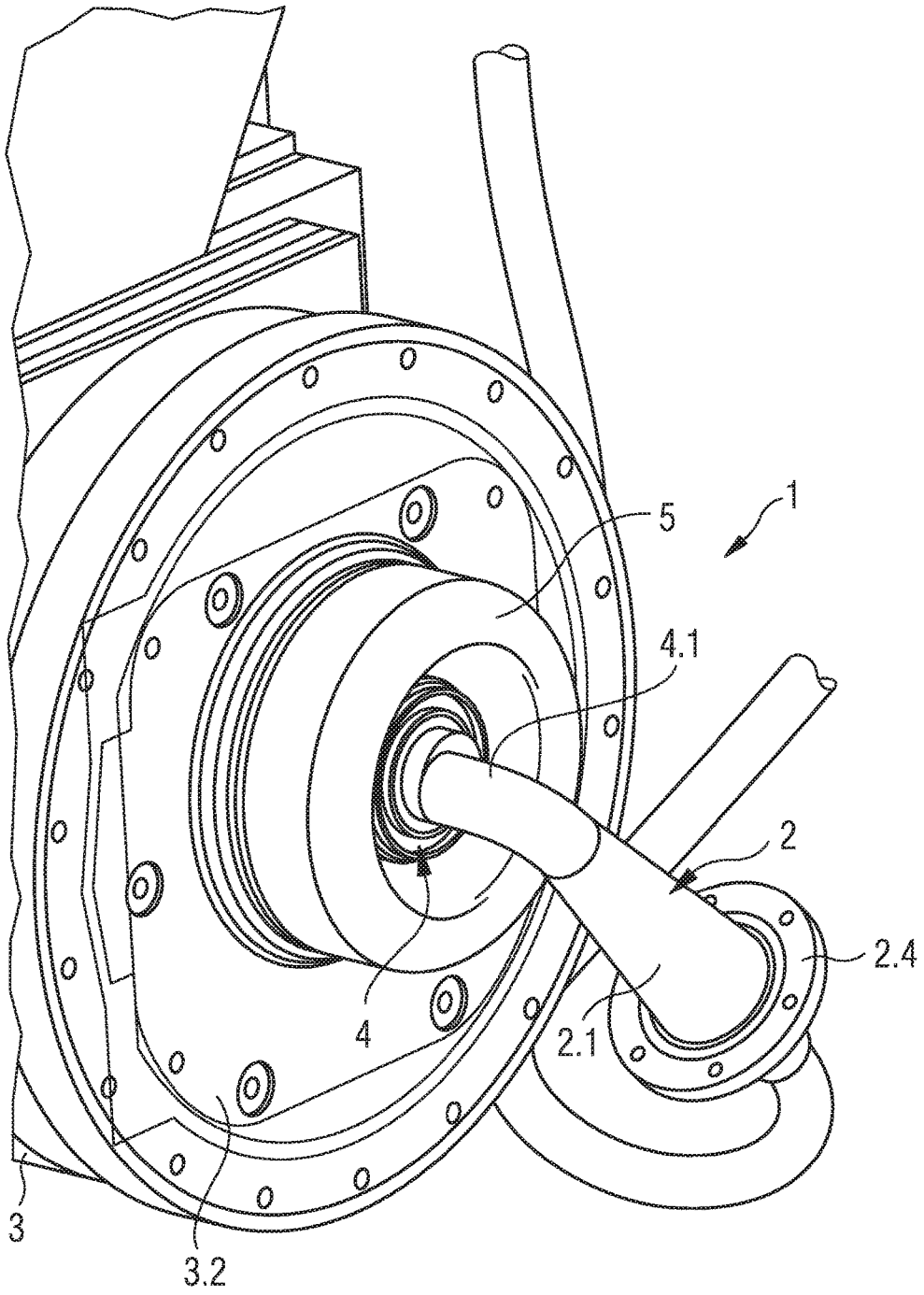
FIG. 1 is a diagrammatic, perspective view of a partial segment of an x-ray emitter with a high-voltage supply according to a first exemplary embodiment of the invention.

Corresponding parts are shown with the same reference characters in all the figures.

Figure 2:
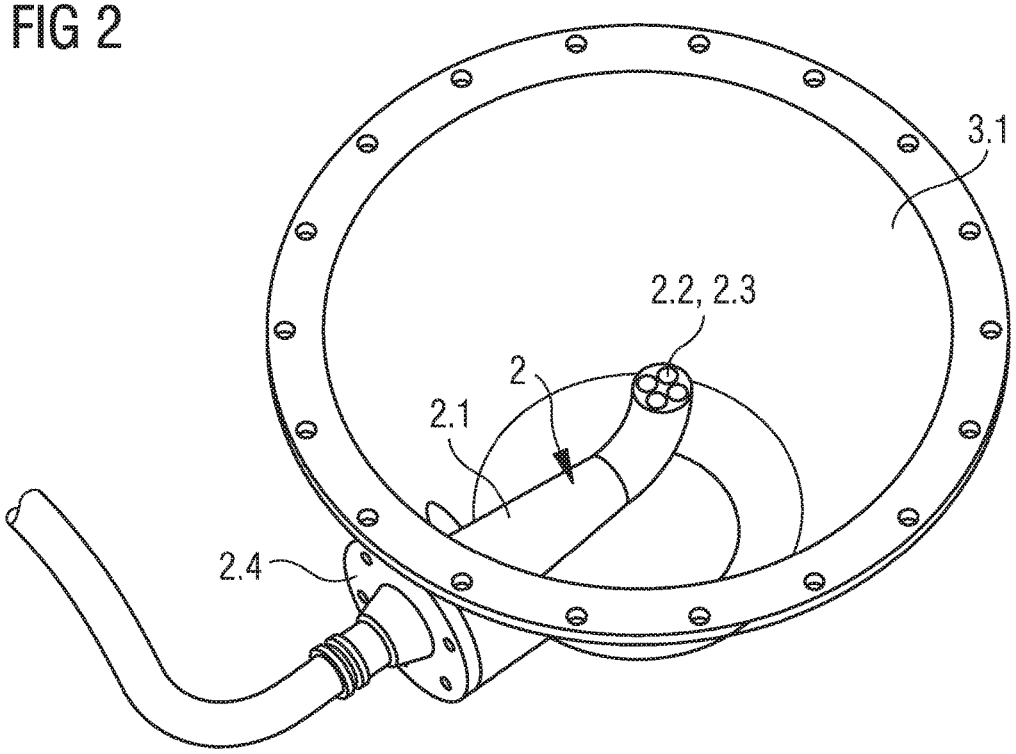
FIG. 2 is a further perspective view of the high-voltage supply of the first exemplary embodiment anchored in a housing part.

Referring now to the figures of the drawings in detail and first, particularly to FIGS. 1 and 2 thereof, there is shown a perspective view of a section from an x-ray emitter 1 with a high-voltage supply 2. To show the relevant components more clearly a housing part 3.1, which in the mounted state encloses a cathode connector part 4 and the high-voltage supply 2, is omitted. However the housing part 3.1 in question is shown in FIG. 2.

The housing part 3.1 forms a segment of a radiation protection housing 3 of the x-ray emitter 1. The radiation protection housing 3 largely shields the generated x-ray radiation during operation. The radiation protection housing 3 also has a window, which is permeable for at least a wavelength range of the generated x-ray radiation, so that it can leave the radiation protection housing 3 in a defined spatial angle range to capture image data.

The x-ray emitter 1 is of the type having rotating anodes. A vacuum housing is arranged in a region of the radiation protection housing 3 separated from a wall 3.2 in a manner not shown in detail, the vacuum housing functioning as an x-ray tube. Arranged within the vacuum housing 5 are a rotatably supported anode and a cathode, which is supplied with a cathode current by way of the cathode connector part 4. High-voltage is supplied to the cathode voltage equally by way of the cathode connector part 4 and the high-voltage supply 2 connected thereto. The cathode current is supplied by the high-voltage supply 2 at the potential of the cathode voltage. Cathode insulation 5 insulates the cathode electrically from the anode or from the vacuum housing, which is at earth potential in the illustrated exemplary embodiment.

The high-voltage supply 2 of the first exemplary embodiment shown in FIGS. 1 and 2 has an insulating body 2.1 made of an electrically insulating material, in which four electrical conductors 2.2 are incorporated in such a manner that they are insulated from one another. The electrical conductors 2.2 are provided with connector elements 2.3 at one end, these being configured for electrical contact with correspondingly configured connectors 4.1 of the cathode connector part 4. The connector elements 2.3 of the first exemplary embodiment are in the form of connector sockets which make contact with connectors 4.1, which are configured as connector pins, in the mounted state.

The high-voltage supply 2 of the first exemplary embodiment has an angled outer shape, in order to utilize the available space optimally. The four electrical conductors 2.2 therefore run along curved paths within the insulating body 2.1. In the mounted state the front, angled part of the high-voltage supply 2 makes contact with the connector elements 2.3 of the cathode connector part 4 arranged there. To this end the high-voltage supply 2.1 is fastened in such a manner in relation to the radiation protection housing 3 in the mounted state that the angled part of the high-voltage supply 2 is held in a stable manner in the desired position. The insulating body 2.1 has a fastening device in the form of a flange 2.4, to which the housing part 3.1 can be fastened in a fixed manner by screws, rivets or the like.

In the mounted state the housing part 3.1 is connected in a fixed manner to the wall 3.2. The inner region separated from the wall 3.2 and the housing part 3.1 is fluid-tight. In the operating state a liquid or gaseous and electrically insulating medium, for example oil, is introduced in the inner region, enclosing the high-voltage supply 2 and thus increasing flashover resistance. The liquid medium can also serve as a coolant and in particular to dissipate heat that occurs when the x-ray radiation is generated.

In other exemplary embodiments the medium is nitrogen or $SF_6$.

Figure 3:
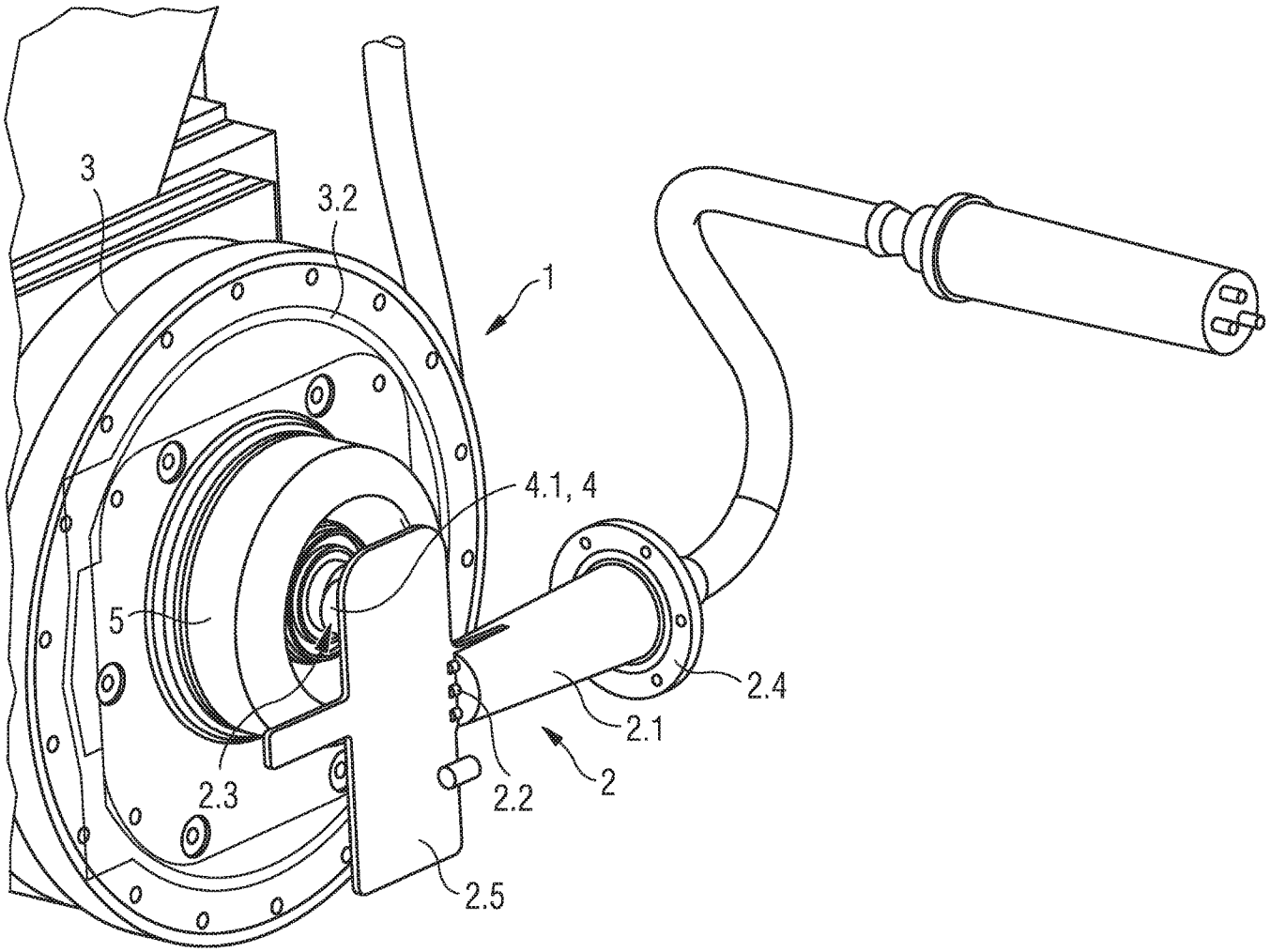
FIG. 3 is a perspective view of a partial segment of the x-ray emitter with the high-voltage supply according to a second exemplary embodiment of the invention.
Figure 4:
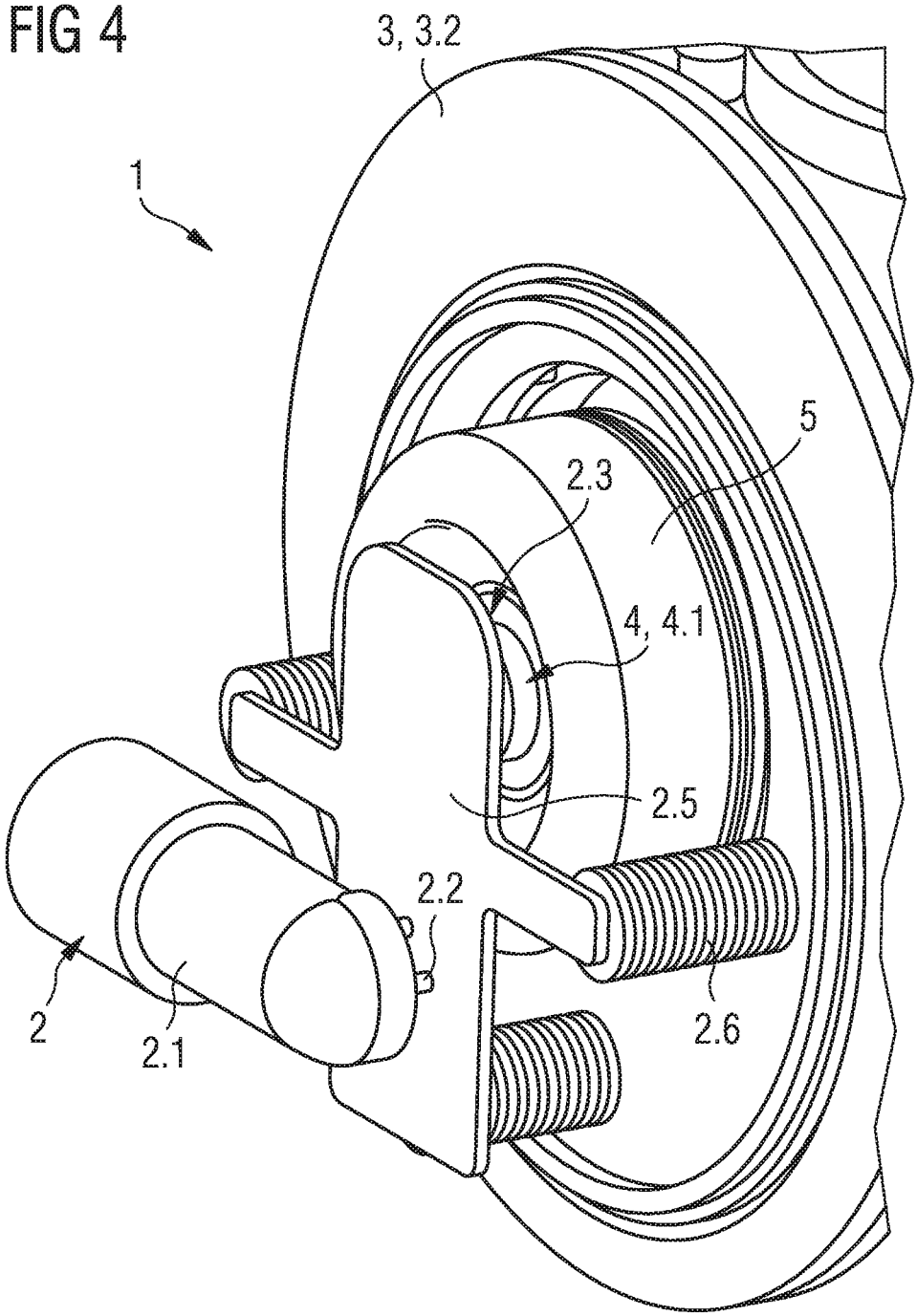
FIG. 4 is shows a perspective view of a partial segment of the x-ray emitter with the high-voltage supply according to a third exemplary embodiment of the invention.

FIGS. 3 and 4 show further exemplary embodiments of the invention. Essentially the second exemplary embodiment shown in FIG. 3 and the third exemplary embodiment shown in FIG. 4 correspond to the first exemplary embodiment, so reference should be made to the description relating to FIGS. 1 and 2. The further descriptions in the following are mainly restricted to the differences in relation to the first exemplary embodiment.

The second and third exemplary embodiments have boards 2.5 to supply the cathode current and cathode voltage. The board 2.5 is in electrical contact with the electrical conductors 2.2 incorporated in the insulating body 2.1. The connector elements 2.3 assigned to the electrical conductors 2.2 are arranged on the board 2.5 and connected to the corresponding electrical conductors 2.2 in an electrically conducting manner by way of conduction paths. In the operating state the boards 2.5 are enclosed by the liquid or gaseous, electrically insulating medium which has been introduced in the inner region between wall 3.2 and housing part 3.1.

In contrast to the first exemplary embodiment only three electrical conductors 2.2 are provided to supply the cathode current and cathode voltage in the second and third exemplary embodiments. In other words the high-voltage supply 2 of the embodiments shown by way of example in FIGS. 3 and 4 is configured as three-pole. The connector elements 2.3 are pin-shaped, being thus embodied as connector pins. In other exemplary embodiments blade contacts are provided as connector elements 2.3, making contact with correspondingly configured socket-type connectors 4.1.

In the second exemplary embodiment in FIG. 3 the plug-type insulating body 2.1 is straight. The electrical conductors 2.2 are passed through the insulating body 2.1 and make contact with conduction paths on the board 2.5, which are connected to the connector elements 2.3 in an electrically conducting manner. The board 2.5 is fastened in the illustrated position by way of the insulating body 2.1, which is fastened to the housing part 3.1 by the flange 2.4 according to the arrangement of the first exemplary embodiment. The latter housing part 3.1 is however not shown in FIG. 3.

In the third exemplary embodiment in FIG. 4 the insulating body 2.1 forms an angled plug. The three electrical conductors 2.2 incorporated in the insulating body 2.1 therefore run in a curved manner. To improve mechanical stability, insulation elements 2.6 are also provided which brace the board 2.5 in relation to the wall 3.2. The insulation elements 2.6 have a cylindrically symmetrical shape and have plate-like extensions projecting in the radial direction. Such an embodiment increases the creep distance, thus ensuring adequate flashover resistance with voltage differences from 10 kV up to 200 kV.

Although the invention has been illustrated and described in detail using the preferred exemplary embodiment, the invention is not restricted by the exemplary embodiments illustrated in the figures. Other variations and combinations can be derived therefrom by the person skilled in the art without departing from the scope of protection of the invention.

The invention claimed is:

1. A high-voltage supply for an x-ray emitter, including provision of a cathode current and a cathode voltage, the high-voltage supply comprising:

a common insulating body;

connector elements configured for electrically conducting contact with corresponding connectors of the x-ray emitter;

at least two electrical conductors incorporated in said common insulating body, each of said at least two electrical conductors being assigned to one of said connector elements; and a board, said connector elements disposed on said board, and each of said connector elements is connected to an assigned one of said electrical conductors in an electrically conducting manner by way of conduction paths.

2. The high-voltage supply according to claim 1, wherein said common insulating body has a flange for connection to a radiation protection housing of the x-ray emitter.

3. The high-voltage supply according to claim 1, further comprising at least one electrically insulating insulation element for bracing said board against a wall of the radiation protection housing.

4. The high-voltage supply according to claim 3, wherein said at least one electrically insulating insulation element has a ribbed shape to lengthen a creep distance.

5. The high-voltage supply according to claim 1, wherein said at least two electrical conductors run in a curved manner within said common insulating body.

6. The high-voltage supply according to claim 1, wherein said connector elements are configured to provide a plug-type connection to corresponding and complementarily configured connectors of the x-ray emitter.

7. The high-voltage supply according to claim 6, wherein said connector elements are configured as connector pins, connector sockets, or blade contacts.

8. An x-ray emitter, comprising:

cathode connectors;

at least one vacuum housing;

a radiation protection housing enclosing said at least one vacuum housing;

a high-voltage supply containing a common insulating body, connector elements configured for electrically conducting contact with corresponding ones of said cathode connectors, and at least two electrical conductors;

said cathode connectors disposed within said radiation protection housing to provide a cathode current and a cathode voltage;

said high-voltage supply extending at least in part over an inner region of said radiation protection housing;

a liquid or gaseous, electrically insulating medium disposed in said inner region; and said at least two electrical conductors of said high-voltage supply being incorporated in said common insulating body, and each of said at least two electrical conductors being assigned to one of said connector elements, which provides an electrically conducting connection to one of said cathode connectors in each instance.

9. The x-ray emitter according to claim 8, further comprising a flange, said high-voltage supply is connected to said radiation protection housing by means of said flange disposed on said common insulating body.

10. The x-ray emitter according to claim 8, further comprising a board, said connector elements are disposed on said board, and each of said connector elements is connected to an assigned one of said at least two electrical conductors in an electrically conducting manner by way of conduction paths.

11. The x-ray emitter according to claim 10, further comprising at least one electrically insulating insulation element;

wherein said radiation protection housing has a wall; and wherein said board is fastened to said wall of said radiation protection housing by means of said at least one electrically insulating insulation element.

12. The x-ray emitter according to claim 8, wherein said connector elements of said high-voltage supply form a plug-type connection with said cathode connectors.

* * * * *